US009803363B2

(12) United States Patent
Trenerry

(10) Patent No.: US 9,803,363 B2
(45) Date of Patent: Oct. 31, 2017

(54) BUILDING FLOOR STRUCTURE AND PROCESS FOR FORMING SAME

(75) Inventor: John Trenerry, North Sydney (AU)

(73) Assignee: HOLDIP PTY LTD. (AU)

( * ) Notice: Subject to any disclaimer, the term of this patent is extended or adjusted under 35 U.S.C. 154(b) by 750 days.

(21) Appl. No.: 13/384,500

(22) PCT Filed: Jul. 14, 2010

(86) PCT No.: PCT/AU2010/000897

§ 371 (c)(1),
(2), (4) Date: Jan. 17, 2012

(87) PCT Pub. No.: WO2011/006202

PCT Pub. Date: Jan. 20, 2011

(65) Prior Publication Data

US 2012/0117911 A1 May 17, 2012

(30) Foreign Application Priority Data

Jul. 14, 2009 (AU) ..... 2009903288

(51) Int. Cl.

| | |
|---|---|
| ***E04B 5/17*** | (2006.01) |
| ***E04B 5/40*** | (2006.01) |
| ***E04B 5/26*** | (2006.01) |
| ***E04B 1/24*** | (2006.01) |

(52) U.S. Cl.

CPC ..... *E04B 5/26* (2013.01); *E04B 1/24* (2013.01); *E04B 5/40* (2013.01); *E04B 2001/2415* (2013.01)

(58) Field of Classification Search

CPC ..... E04B 9/36; E04B 2005/322; E04B 5/36; E04B 5/26; E04C 2003/0452; E04C 2003/0491

USPC ... 52/650.1, 650.3, 319, 320, 321, 322, 250, 52/251

See application file for complete search history.

(56) References Cited

U.S. PATENT DOCUMENTS

| | | | | | |
|---|---|---|---|---|---|
| 1,679,915 | A | * | 8/1928 | Murray | 52/781 |
| 1,759,908 | A | * | 5/1930 | Lampert | 403/217 |
| 1,955,584 | A | * | 4/1934 | Henderson | 52/241 |
| 2,233,291 | A | * | 2/1941 | Leebov | 52/335 |
| 2,296,863 | A | * | 9/1942 | Miller et al. | 52/261 |
| 2,306,548 | A | * | 12/1942 | Leemhuis | 249/13 |
| 2,949,982 | A | * | 8/1960 | Cobi | 52/645 |
| 3,093,932 | A | * | 6/1963 | Dreier et al. | 52/127.3 |
| 3,108,662 | A | * | 10/1963 | Schick | 52/800.1 |
| 3,357,147 | A | * | 12/1967 | Lerner | 52/326 |
| 3,382,637 | A | * | 5/1968 | Longinotti | 52/320 |
| 3,527,007 | A | * | 9/1970 | McManus | 52/327 |
| 4,151,694 | A | * | 5/1979 | Sriberg et al. | 52/665 |
| 4,628,654 | A | * | 12/1986 | Boswel | 52/319 |

(Continued)

*Primary Examiner* — Elizabeth A Quast

(74) *Attorney, Agent, or Firm* — Mayback & Hoffman, P.A.; Gregory L. Mayback; Rebecca A. Tie

(57) ABSTRACT

A building floor structure and a process for constructing the building floor structure comprising two or more spaced-apart beams, each beam comprising an upwardly facing support surface on at least one side of the beam; and one or more frameworks positioned between and adjacent two of the two or more spaced-apart beams, each of the one or more frameworks having two side regions, each side region comprising a downwardly facing bearing surface adapted to be received on the upwardly facing support surface of the respective beam.

11 Claims, 8 Drawing Sheets

(56) References Cited

U.S. PATENT DOCUMENTS

| | | | | |
|---|---|---|---|---|
| 5,152,114 | A * | 10/1992 | Beazley et al. | 52/264 |
| 5,544,464 | A * | 8/1996 | Dutil | 52/330 |
| 5,941,035 | A * | 8/1999 | Purse | 52/263 |
| 6,128,878 | A * | 10/2000 | Erickson | 52/319 |
| 6,341,456 | B1 * | 1/2002 | Majnaric et al. | 52/834 |
| 7,647,742 | B2 * | 1/2010 | Han | 52/741.1 |
| 7,730,692 | B1 * | 6/2010 | Hershey | 52/634 |
| 8,056,291 | B1 * | 11/2011 | diGirolamo et al. | 52/250 |
| 2004/0107660 | A1 * | 6/2004 | Moreau | 52/336 |
| 2004/0148885 | A1 * | 8/2004 | Femminella | 52/319 |
| 2010/0024331 | A1 * | 2/2010 | Stiffler et al. | 52/236.8 |
| 2010/0275544 | A1 * | 11/2010 | Studebaker et al. | 52/582.1 |

* cited by examiner

BUILDING FLOOR STRUCTURE AND PROCESS FOR FORMING SAME

CROSS-REFERENCE TO RELATED APPLICATIONS

This application claims the priority, under 35 U.S.C. §119, 120, 363, and 371, of Australian Patent Application No. 2009903288, filed Jul. 14, 2009, and International Application No. PCT/AU2010/000897, filed Jul. 24, 2010, which designated the United States, these prior applications are herewith incorporated by reference in their entirety.

STATEMENT REGARDING FEDERALLY SPONSORED RESEARCH OR DEVELOPMENT n/a

FIELD OF THE INVENTION

The present invention relates to floor construction and, in particular, to building floor structures.

The invention has been developed primarily for use in the construction of multi-story buildings and will be described hereinafter with reference to this application. However, it will be appreciated that the invention is not limited to this particular field of use and can be used in relation to any structure requiring flooring (e.g., single floor buildings). The same floor structure can also be used in roofing.

BACKGROUND

Concrete slabs are made by providing a formwork that supports wet concrete until it has achieved sufficient strength to support itself and any imposed loads. Reinforcing steel is positioned on the formwork via chairs that set the required depth to finished concrete surfaces. The most conventional formwork consists of plywood boards, load distributing timber beams and braced structural props. The construction and removal of these elements has a high degree of risk. Stripping of formwork from a cured concrete slab involves progressively removing props, beams and boards from overhead and therefore serious consequence in the event of any incident. Whilst props, beams and formwork are in place during concrete cure, it is impractical to commence following trade work on that level. This constrains the speed at which construction of the building can occur.

Re-useable steel formwork and decking are known and can provide better quality and efficiency over plywood, but can be more expensive and are not as easily suited to complicated forms and levels.

Any reusable formwork system has a finite lifespan. Typically, plywood form boards would be used five to ten times before they would need to be replaced. Any damage and surface irregularity translates directly into the quality of finish on the concrete surface being formed. This becomes important where certain concrete class finish levels are required.

The most sophisticated current formwork systems include the use of a self-supporting deck which spans one-way between intermediate concrete or steel composite beams or load bearing walls. These decks are left in place and are therefore known as lost-formwork. Lost formwork systems include steel decking, fibre cement sheets, pre-cast concrete panels or plates (often with steel reinforcement exposed to engage with the concrete and reinforcement being placed on top). When there is an engagement between the concrete and a lost formwork decking, it can act in a composite manner thereby improving the load bearing capacity and deflection performance of the overall floor section.

Benefits of lost formwork systems include:

1. Support for wet concrete minimizing propping and beam support underneath the floor—materials handling improvements and better OH&S outcomes;
2. Composite construction results in greater strength;
3. Reduction in steel reinforcement required in the slab, e.g., steel decking formwork can act as bottom reinforcement in the slab, so only top steel is required;
4. Labor savings; and
5. Speed—no stripping of formwork—and can progress with works on level below earlier than with an off-form concrete system.

Composite metal decking is best employed laid over the top of steel beams. The resulting floor depth is the depth of the concrete floor element plus the beam. It is advantageous to minimize the depth of the floor including the beam, for example to minimize the overall height of the building or to maximize the number of floors within a building envelope, so this is not always the best solution. Composite metal decking can be placed on the bottom flange of the beam so that the beam is encased in concrete. Typically this would be a fabricated I-beam with a wider bottom flange. Another advantage of this method is the encasement of the full beam with concrete except for the underside of the bottom flange. The beam has a better capacity to resist fire without additional protection in that configuration and, if additional protection is required, it is to one surface only. However, the trade-off is an increase in the volume of concrete required for the floor with a consequent increase in mass with consequently heavier structural support members and footings. A better solution for composite metal decking is to fix to support angles fabricated part-way up the web of the beam. This encases the top of the beam while reducing the volume of concrete required for the floor. The trade-off in this case is additional fabrication work on the beam, reduced inherent fire performance with full three-sided fire protection required.

When lightweight pre-cast concrete panels, for example Hollowcore or AAC, are used as the lost formwork and placed on the bottom flange of a steel I-beam, the benefit of reducing the overall depth of the floor is achieved while also keeping the volume of concrete required to complete the floor to a minimum. These panels are less likely to need propping during the concrete pour and initial set due to their inherent structural capacity; in fact they are rarely designed to work compositely. The trade-off is that, while lighter in mass than concrete, they are heavier than composite metal decking, do not act as efficiently as a heat sink under fire conditions as normal poured concrete placed on the bottom flange, and have significantly higher cost than composite metal decking.

Void formers of polystyrene or other similar material incorporated on the top of sheet steel lost formwork can minimize the required volume of concrete but the process is complicated, adds significant cost and does not add to the structural capacity of the sheeting; in fact, it prevents the sheets from acting compositely with the concrete unless there are channels left for concrete to engage with the profiles, which defeats the purpose.

Lost formwork decking must be able to support the load of wet concrete as it's poured, together with point loading from the people laying and finishing it. Sheet steel lost formwork must provide the full load bearing capacity under that construction loading condition, that is, it must be a self-supporting metal deck. Consequently, the material content in the decking will be high relative to a composite metal deck which requires propping to handle that construction loading condition, but once the concrete has cured, it has sufficient strength to resist in-service loading conditions on its full span. When composite metal decking is propped, it is done in line so as to break up the full span between end supports. This means that beams must still be used to provide an even support. As previously discussed, removing temporary support beams from overhead represents a significant safety risk.

Sheet steel lost formwork and composite metal decks must be secured to the supports by self-drilling screws, spot welds, pins, some other mechanical means, or integrally with shear lugs, if the steel beam is to be composite with the slab, in order to prevent movement during construction from wind, human traffic and impacts from the concrete pour. Metal decking comes in sheets around 300 to 1100 mm wide and are installed individually on site once all the support beams are in place. Metal decking also requires void closers to be installed to prevent flow of wet concrete out of the floor deck to the level below.

Ceilings are usually suspended underneath concrete slabs via suspension rods, ties or straps that are anchored into the concrete. Installing anchors by drilling into concrete causes dust that is a health risk to the installer if inhaled. On sheet steel lost formwork, clips or anchoring mechanisms that work within the deck profile avoid this, but add to cost.

Pre-cast floor panels are craned into position one single unit at a time and this imposes a large constraint on crane time and its servicing of other areas on the site. Packs of composite metal decking can be delivered to the level in a single crane lift, but then must be installed manually.

Composite steel and concrete beams rely on shear lugs 90+ mm long with flanged heads welded to the top of the beams. This requires a fairly thick cover of concrete over the beam, going against the principle of reducing overall floor depth and mass. It is a process usually done on-site by welding through the composite metal decking, which, if it is galvanized as is usually the case, will release harmful gases.

The present invention seeks to provide a building floor structure and process for forming the same which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention, a building floor structure is provided, comprising:

- two or more spaced-apart beams, each beam comprising an upwardly facing support surface on at least one side of the beam; and
- one or more frameworks positioned between and adjacent two of the two or more spaced-apart beams, each of the one or more frameworks having two side regions, each side region comprising a downwardly facing bearing surface adapted to be received on the upwardly facing support surface of the respective beam.

Advantageously, the building floor structure uses less concrete than laying decking members on the bottom flange of an I-beam.

Advantageously, the overall depth of the floor from the top surface of the concrete to the underside of the beam is less than using composite metal decking fixed to the top flange of the beam.

Advantageously, the one or more frameworks can be prefabricated and located in position on-site. This reduces on-site labor requirements and increases the speed of construction on-site.

Advantageously, the one or more frameworks, when adapted to support the weight of concrete and loading before the concrete has set, do not require a temporary support structure underneath. Consequently, the risk of injury or death can be reduced.

Preferably, each framework has a framework bottom surface and the bearing surfaces are not in the same plane as the framework bottom surface.

Advantageously, if the framework bottom surface is above the bearing surface, the amount of concrete required to create a composite floor will be less, if the framework bottom surface is below the bearing surface, battens with a smaller cross-section can be used and if the framework bottom surface is below the beam bottom surface, ceiling elements can be attached directly to the framework.

Preferably, each beam has a beam bottom surface and each framework bottom surface is located at or below the height of the beam bottom surfaces.

Advantageously, ceiling lining can be installed by attaching it directly to the framework. This removes the need to suspend a ceiling frame or provide ceiling battens and creates a flat ceiling. Preferably, each framework further comprises recessed portions defining the bearing surfaces.

Preferably, each framework further comprises:

- two or more spaced-apart bearers aligned with the beams; and
- two or more spaced-apart joists attached and extending transversely to the bearers.

Preferably, the bearing surfaces of each framework are provided by bottom surfaces of respective bearers.

Advantageously, the joists can be attached to the bearers at a height offset to suit the desired thickness of concrete and the location of the ceiling plane.

Preferably, the building floor structure further comprises two or more elongate plates corresponding to the two or more beams, each plate being aligned with and welded to the beam bottom surface and having at least one side extending horizontally beyond the width of the beam to provide the support surface.

Advantageously, the one or more frameworks can be used with beams of any cross-section. Preferably, each framework further comprises:

- one or more horizontally disposed decking members positioned on top of the two or more spaced-apart joists; and
- a volume of concrete substantially filling the volume defined by the beams, bearers, joists and one or more decking members and covering top surfaces of the beams and thereby providing a top surface to the floor structure.

Preferably, each of the beams further comprises an elongate, laterally extending beam flange aligned with the beam on at least one side of the beam, the support surface being provided by an upper surface of the beam flange.

Advantageously, the thickness of concrete required to cover the top surfaces of the beams is less resulting in reduced overall floor thickness.

Preferably, the beams are I-beams, each I-beam comprising a horizontally oriented top flange, a horizontally orientated bottom flange and a vertically oriented web connecting the top flange to the bottom flange.

Preferably, the bottom flange of each I-beam is wider than the top flange and wherein the support surface is provided by an upper surface of the bottom flange.

Advantageously, the frameworks can be more easily positioned on the I-beams.

Preferably, each beam has a top surface and the volume of concrete covers the top surfaces of the beams.

Advantageously, a better interlock between the beams and the volume of concrete is achieved providing greater strength and rigidity.

Preferably, the building floor structure further comprises one or more reinforcement members located within the volume of concrete.

Advantageously, the building floor structure is strengthened by the one or more reinforcement members within the volume of concrete.

Preferably, the one or more decking members are attached to the two or more joists.

Advantageously, the framework can be delivered to a building site prefabricated with the one or more decking members.

Preferably, each bearer is attached to the respective plate.

Advantageously, the building floor structure is strengthened by this attachment.

Preferably, each bearer is attached to the respective bottom flange.

Advantageously, the building floor structure is strengthened by this attachment.

Preferably, each beam comprises a plurality of recesses the volume of concrete surrounding the recesses mechanically keying the volume of concrete to the beam.

Preferably, each beam comprises a plurality of lugs the volume of concrete surrounding the lugs mechanically keying the volume of concrete to the beam.

Advantageously, the building floor structure is strengthened by the greater level of interlock between the beams and the volume of concrete and it is less likely that cracks in the volume of concrete will form.

Advantageously, the beams are laterally and torsionally restrained by the concrete block encasing it, improving the dynamic response of the floor (e.g. reducing vibration).

Preferably, the building floor structure further comprises one or more ceiling members attached to framework bottom surfaces of the one or more frameworks.

According to a second aspect of the present invention, a process for constructing a building floor structure is provided, comprising the following steps:

1. providing one or more prefabricated frameworks, each framework comprising a framework bottom surface and two side regions, each side region comprising a downwardly facing bearing surface;
2. locating each of the frameworks, between two adjacent beams, each beam comprising an upwardly facing support surface on each side of the beam facing a framework, such that the bearing surfaces rest on respective support surfaces;
3. pouring a volume of concrete into and above a volume defined by the beams and the one or more frameworks such that the volume of concrete covers the beam top surfaces; and
4. screeding a top surface of the volume of concrete flat.

Advantageously, the process for constructing a building floor structure uses less concrete than laying decking members on the bottom flange of an I-beam.

Advantageously, the overall depth of the floor structure from the top surface of the concrete to the underside of the beams is less than using composite metal decking fixed to the top flange of the beam.

Advantageously, the one or more frameworks can be prefabricated and located in position on-site. This reduces on-site labor requirements and increases the speed of construction on-site.

Advantageously, the one or more frameworks, when adapted to support the weight of concrete and loading before the concrete has set, do not require a temporary support structure underneath. Consequently, the risk of injury or death can be reduced.

Other aspects of the invention are also disclosed.

BRIEF DESCRIPTION OF THE FIGURES

Notwithstanding any other forms which may fall within the scope of the present invention, preferred embodiments of the invention will now be described, by way of example only, with reference to the accompanying drawings in which.

DETAILED DESCRIPTION OF SPECIFIC EMBODIMENTS

Figures 1, 2, 3, 4:
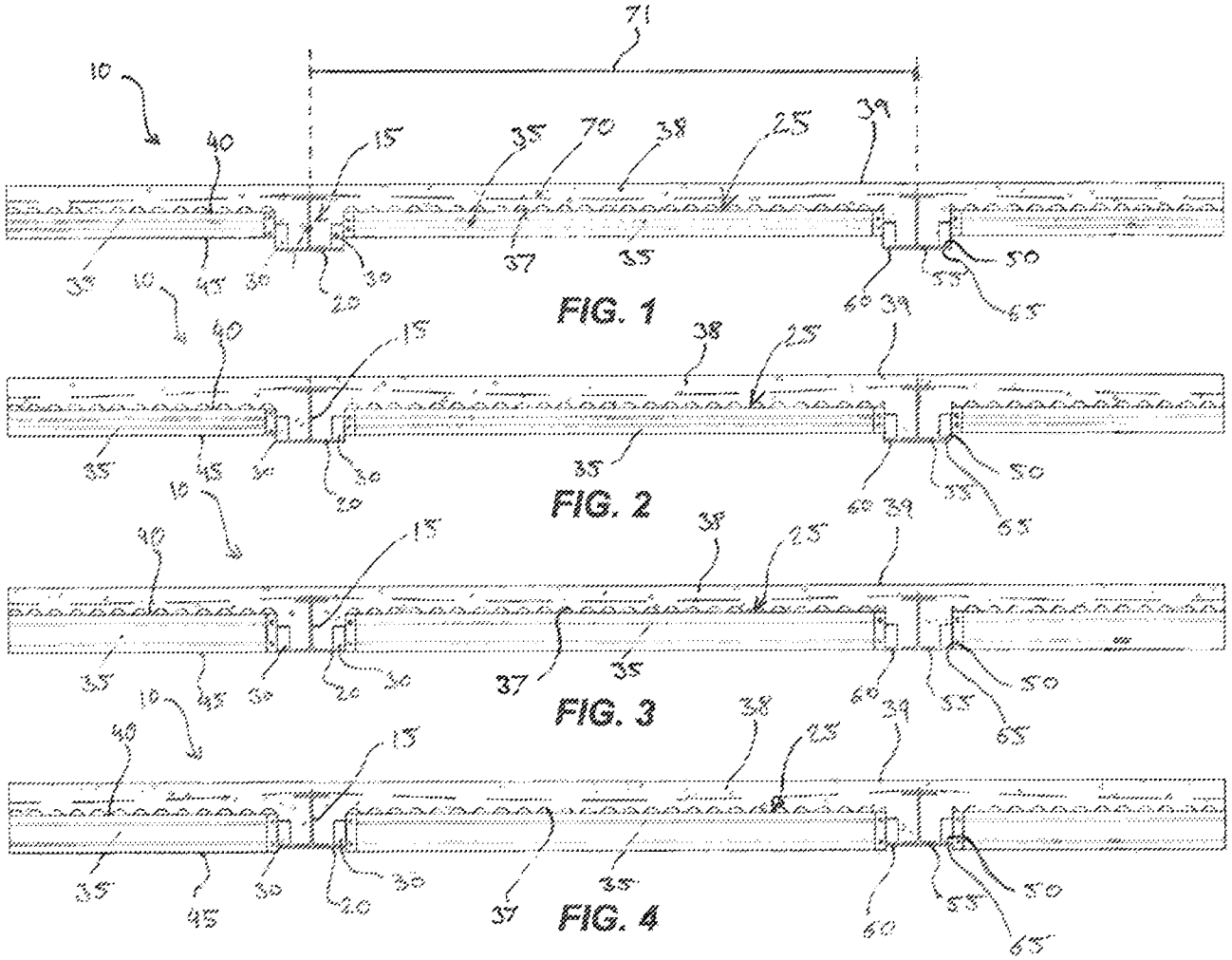
FIG. 1 is a sectional view of a building floor structure in accordance with one of a set of preferred embodiments of the present invention having 200 mm deep intermediate beams.
FIG. 2 is a sectional view of a building floor structure in accordance with a second one of a set of preferred embodiments of the present invention having 200 mm deep intermediate beams.
FIG. 3 is a sectional view of a building floor structure in accordance with a third one of a set of preferred embodiments of the present invention having 200 mm deep intermediate beams.
FIG. 4 is a sectional view of a building floor structure in accordance with a fourth one of a set of preferred embodiments of the present invention having 200 mm deep intermediate beams.
Figures 5, 6, 7, 8:
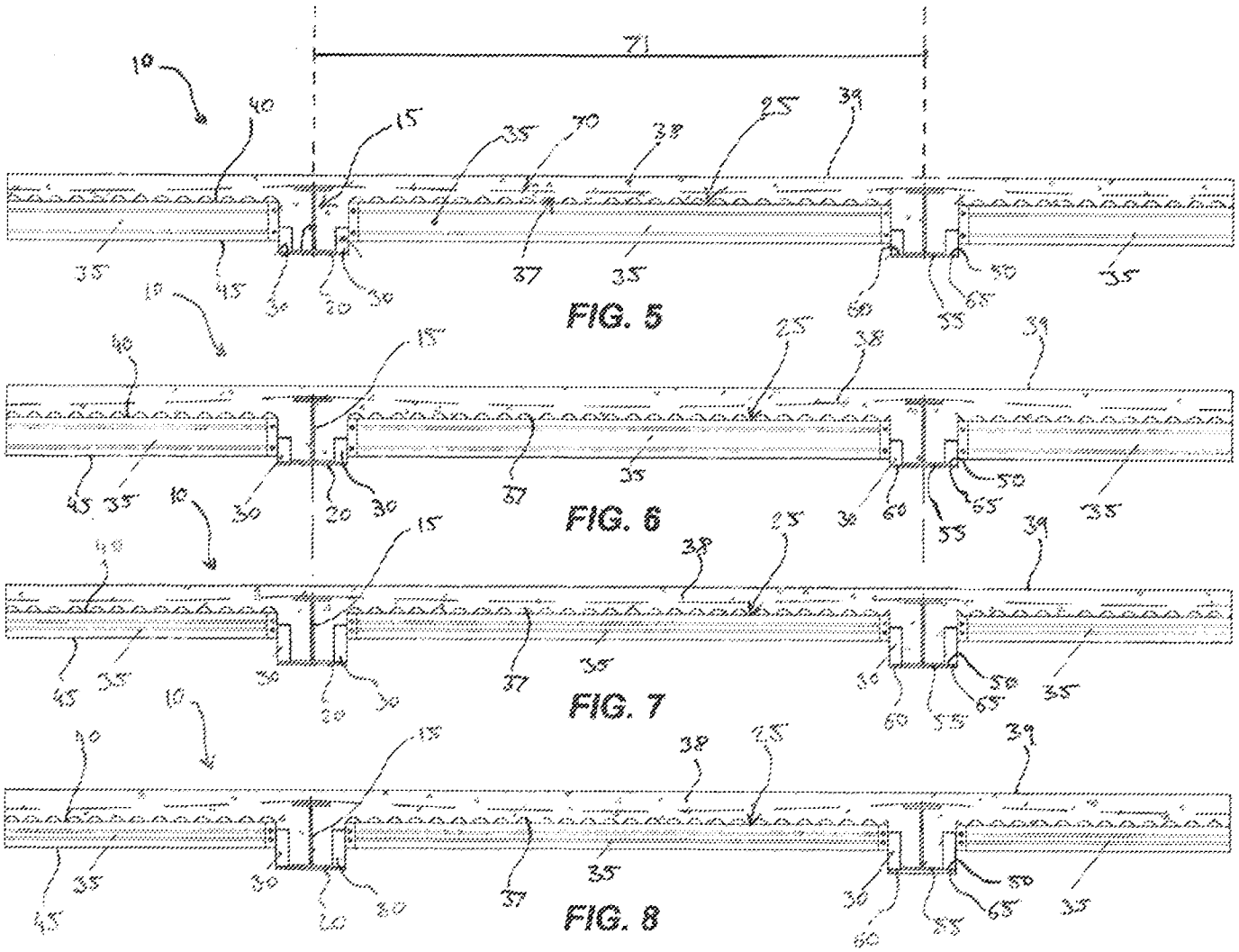
FIG. 5 is a sectional view of a building floor structure in accordance with one of another set of preferred embodiments of the present invention having 250 mm deep intermediate beams.
FIG. 6 is a sectional view of a building floor structure in accordance with a second one of the set of preferred embodiments of the present invention having 250 mm deep intermediate beams.
FIG. 7 is a sectional view of a building floor structure in accordance with a third one of the set of preferred embodiments of the present invention having 250 mm deep intermediate beams.
FIG. 8 is a sectional view of a building floor structure in accordance with a fourth one of the set of preferred embodiments of the present invention having 250 mm deep intermediate beams.

It should be noted in the following description that like or the same reference numerals in different embodiments denote the same or similar features.

Referring to FIGS. 1-8, preferred embodiments of a building floor structure, henceforth referred to as floor structure 10, are shown. The floor structure 10 comprises a series of spaced-apart beams, in this case, I-beams 15, plates 20 welded to respective I-beams and a series of frameworks 25 resting on respective plates 20. Each framework 25 comprises two spaced-apart bearers 30 aligned with the I-beams 15 and a series of spaced-apart joists 35 extending transversely and bridging the gap between the bearers 30.

Figure 9:
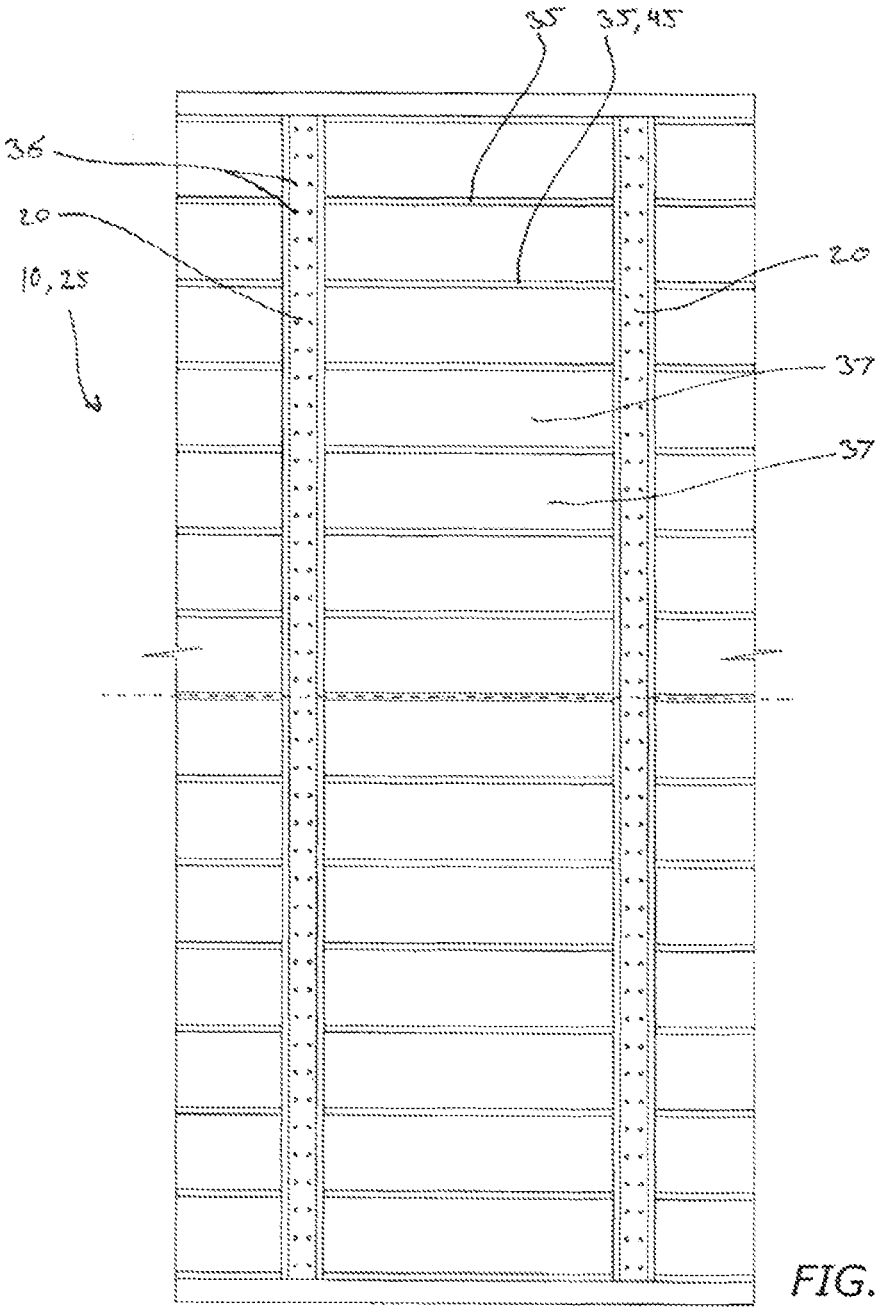
FIG. 9 is a partial plan view of a prefabricated framework including decking elements in accordance with another preferred embodiment of the present invention.

Referring to FIG. 9, the floor structure 10 further comprises a series of horizontally disposed decking panels 37 lying on top of, attached to and traversing the joists 35. The decking panels 37 may overlap or simply abut one another. In this embodiment, the decking panels 37 are fixed to the joists 35 by screws 36. The decking panels 37 run parallel to the bearers 30 and finish on the bearers 30 to ensure formwork closure.

The floor structure 10 also comprises a volume of concrete 38 substantially filling the volume defined by the beams 15, bearers 30, joists 35, decking panels 37 and their edge forms and covering the top surfaces of the I-beams 15 to thereby provide a top surface 39 to the floor structure 10.

Each framework 25 is positioned between and adjacent two of the spaced-apart beams 15. Each framework has a top surface 40 defined as the top surface of the joists 35 and a bottom surface 45 defined as the bottom surface of the joists 35. The framework 25 is designed to have sufficient structural capacity to withstand the construction loading conditions without propping.

Each bearer 30 has a bottom surface and in this embodiment the bottom surface acts as a bearing surface 50 for supporting the respective framework 25. The bearing surface 50 can in various embodiments be above (see FIG. 4) in-line with (see FIG. 3) or below (see FIGS. 1, 2 & 5-8) the bottom surface 45 of the framework 25. The bearers 30 can be attached to the respective I-beams 15. Advantageously, the building floor structure is strengthened by this attachment.

Each plate 20 is aligned with and welded to a bottom surface 55 of a respective beam 15 and extends horizontally beyond the width of the beam. The upper surfaces of the plate 20 provide a first and second support surface 60, 65, respectively, on either side of the respective beam 15. The bearers 30 can either rest on top of or be attached to respective plates 20 for greater strength.

In this embodiment, each I-beam 15 comprises a horizontally oriented top flange, a horizontally orientated bottom flange and a vertically oriented web connecting the center of the top flange to the center of the bottom flange.

Referring to FIG. 4, an embodiment is shown where the bottom surfaces 45 of the frameworks 25 are located below the height of the bottom surfaces 55 of the I-beams 15. This allows ceiling panels (not shown) to be attached directly to the framework 25. This removes the need to suspend a ceiling frame or provide ceiling battens.

The joists 35 can be situated vertically at any position relative to the bearers 30 to achieve the optimum concrete thickness for the required fire resistance loading condition or any other governing design criteria, for example acoustics, and for any ceiling installation requirements. Alternatively, the depth of the joists 35 may be varied to achieve the same optimal concrete thickness.

The floor structure 10 further comprises reinforcing mesh 70 located within the volume of concrete 38. In this embodiment the reinforcing mesh 70 is SL82 but it will be appreciated by the person skilled in the art that any other suitable reinforcing mesh can be used.

The frameworks 25 and decking panels 37 are designed to carry the construction loads associated with wet concrete together with the installers and their equipment without any propping within its span between adjacent beams or supports. When the steel I-beams 15 are designed to be composite, the beam itself can be propped, and this is done with a single prop without additional support material like support beams overhead. This is a much better outcome for site safety than beams and re-useable form boards overhead.

The overall floor thickness is controlled geometrically by the depth of concrete cover over the I-beams 15 and the depth of the beams 15 itself. The depth of concrete cover over the beams 15 is governed by practical limits around reinforcement and crack control. The depth of the I-beams 15 is governed by its span, the floor self-weight, the loading conditions and deflection limits. A framework 25 with decking panels 37 allows the floor self-weight to be reduced without an additional fabrication process on the I-beams 15, such as the installation of composite metal decking support angles on the web, because the bearers 30 can sit on the bottom flange of the I-beams 15.

The framework 25 provides load carrying capacity under normal service conditions removing complication and material from the work decking itself, as required for composite metal decking.

The volume of concrete 38 is designed such that it alone satisfies structural adequacy under fire conditions, thus removing the need to provide separate fire protection to the framework 25 (that is, the framework 25 is redundant under fire conditions).

In this embodiment:

1. The floor structure 10 supports a volume of concrete 38 (i.e. a concrete slab) of thickness between 100 mm and 150 mm. In other embodiments, the thickness can be anywhere up to 1000 mm thick or beyond.
2. The center-to-center spacing 71 of the I-beams 15 is 2400 mm. In other embodiments the center-to-center spacing 71 can be anywhere up to 5000 mm or beyond.
3. The framework width 72 is the same as the spacing 71 of the I-beams 15 less the width 73 of the top flange of the beam, less a clearance for site variation and assembly tolerances, such that the framework 25 can be installed between adjacent I-beams 15 bearing on the plates 20.

The floor structure 10 offers a number of advantages, including:

1. The use of a framework 25 creates a void between the bottom flanges of the I-beams 15 and the decking panels 37 (underside of the concrete) and this reduces concrete volume in the structure saving cost in concrete, reinforcing steel and saving consequential cost associated with lightening the structure and footings. In other words, the framework 25 uses less concrete than laying decking panels on the bottom flanges of I-beams.
2. Advantageously, the overall depth of the floor structure 10 from the top surface of the concrete to the underside of the I-beams 15 is less than using composite metal decking fixed to the top flanges of the I-beams 15.
3. The frameworks 25 can be prefabricated and located in position on-site. This reduces on-site labor requirements and increases the speed of construction on-site.
4. The frameworks 25, when adapted to support the weight of concrete and loading before the concrete has set, do not require a temporary support structure underneath. Consequently, the risk of injury or death can be reduced.
5. In embodiments where the bottom surface 45 of the framework 25 is above the bearing surface 50, the amount of concrete required to create a composite floor will be less, if the framework bottom surface 45 is below the bearing surface 50, battens with a smaller cross-section can be used and if the framework bottom surface 45 is below the bottom surface 55 of the I-beams 15, the ceiling panels can be attached directly to the framework 25.
6. Advantageously, the joists 35 can be attached to the bearers 30 at a height offset to reduce the cross-sectional requirement of the joists 35.
7. The volume of concrete 38 surrounding the top of the I-beams 35 creates a better interlock between the I-beams 35 and the volume of concrete 38 thereby providing greater strength and rigidity.
8. Encasement of the I-beam 15, either in part or in full, in concrete, completely filling the space between the flanges of the I-beam 15 offers a number of advantages, including:
   a. It stabilizes the I-beam 15 to increase its structural capacity.
   b. It creates a shear key to keep the volume of concrete 38 bonded to the I-beam 15, that is, the concrete cover over the top of the I-beam 15 prevents it from buckling up (delaminating) under load.
   c. It protects the beam from loss of structural integrity from temperature increase in fire scenarios.
   d. It reduces the amount of or obviates the need for additional fire protection treatment, such as sprays, required due to the low exposed surface area to mass ratio used to determine coating thickness.
9. The I-beams 15 are laterally and torsionally restrained by the concrete block encasing it, improving the dynamic response of the floor 10 (e.g. reducing vibration).

Referring to FIGS. 10-16, the I-beams 15 preferably have a mechanism for transferring shear at the top flange to facilitate composite action with the volume of concrete 38.

Figure 10:
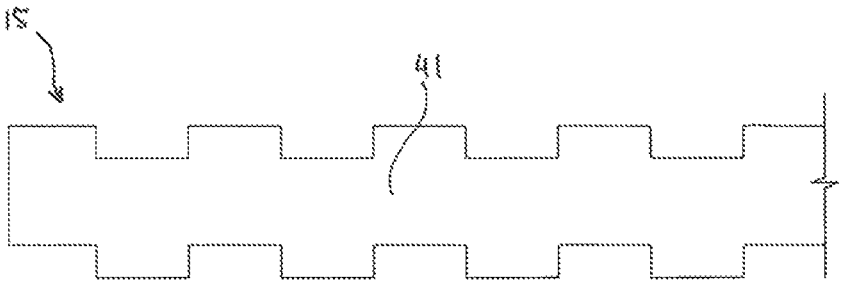
FIG. 10 is a partial plan view of a top flange of a preferred intermediate beam having integral deformations for shear transfer in accordance with another preferred embodiment of the present invention.

Referring to FIG. 10, a profile taking the form of a castellated top flange 41 of one of the I-beams 15 is shown. This arrangement provides a greater level of interlock between the I-beams 15 and the volume of concrete 38. This may be formed by cutting from the side edges of the top flange of the I-beams 15. Alternatively, spaced blocks may be welded to the top flange.

Figure 11:
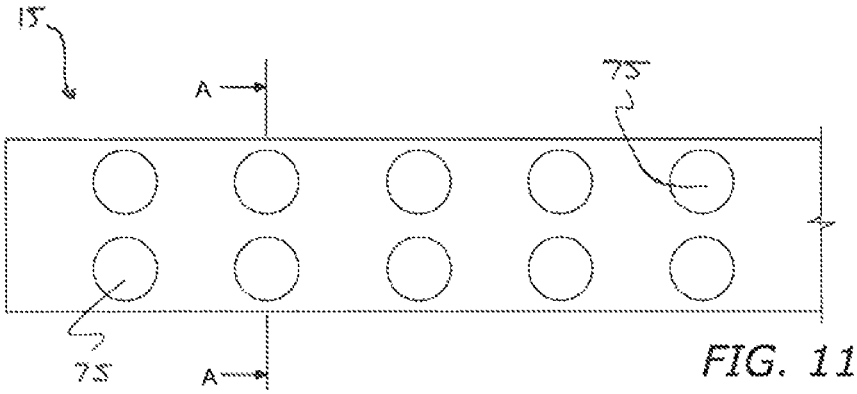
FIG. 11 is a partial plan view of a top flange of a preferred intermediate beam having preferred shear studs installed in accordance with another preferred embodiment of the present invention.
Figure 12:
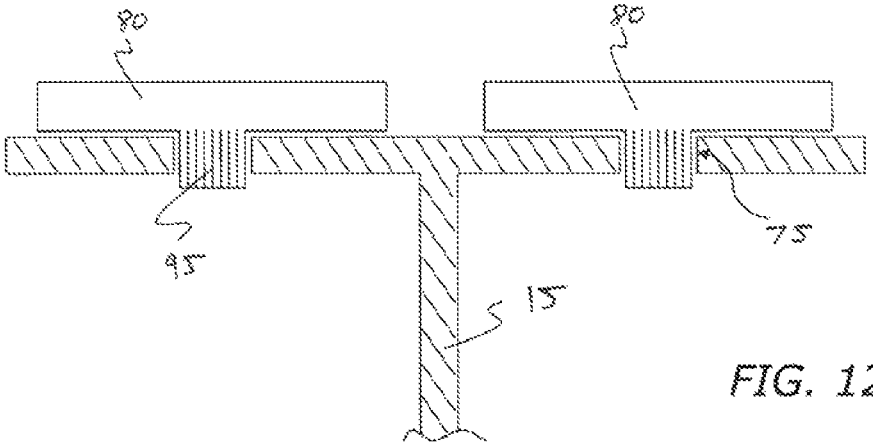
FIG. 12 is a partial, detail section view of Section A-A of FIG. 11 showing preferred shear lugs located in pre-punched holes in the top flange of the beam.

Referring to FIGS. 11 & 12, another embodiment is shown where the I-beams 15 each comprise a plurality of recesses 75 and the building floor structure 10 further comprises a plurality of corresponding shear lugs 80 for placement in the recesses 75 during the construction process. The top surface 39 of the floor structure 10 covers and surrounds the shear lugs 80. The shear lugs 80 provide a greater level of interlock between the I-beams 15 and the volume of concrete 38. The shear lugs 80 are flat and are preferably round or square in plan view. The lugs 80 can have a greater width than height and do not need to be flanged at the top as is the case with conventional shear lugs. They can also be effectively installed off-site prior to delivery, again taking labor away from the construction site. In this embodiment, the shear lugs 80 have a slight interference fit affected by ridges 95 to secure the shear lugs 80 in the recesses 75. It has already been discussed that the encasement of the beam 15 creates a shear key, so it is not necessary to have flanged tops on the shear lugs 80.

Figure 13:
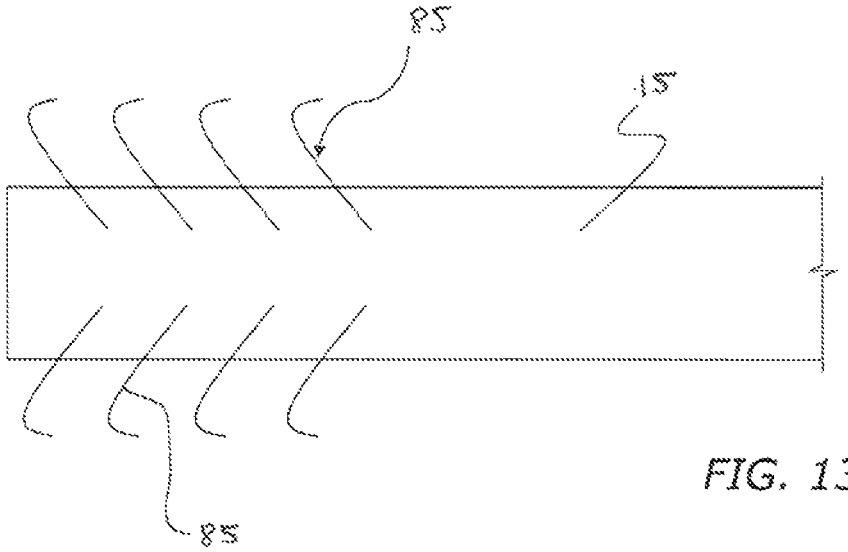
FIG. 13 is a partial, schematic plan view of a top flange of a preferred intermediate beam using deformed bars as a shear transfer mechanism in accordance with another preferred embodiment of the present invention.

Referring to FIG. 13, another embodiment is shown and comprises a series of cogged deformed bars 85 fillet welded to the top flange of the I-beam 15. In this embodiment, the required shear force is achieved through anchorage in the concrete. This can be done off-site.

Figure 14:
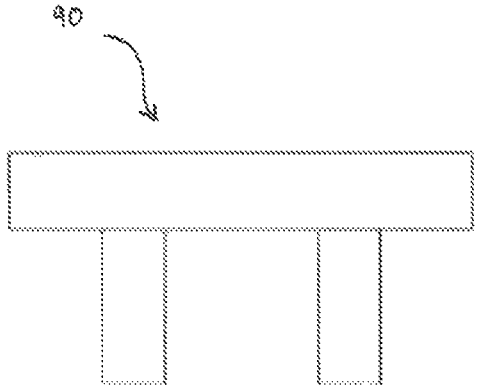
FIG. 14 is a side view of a dual sheer lug in accordance with another preferred embodiment of the present invention.

Referring to FIG. 14, an alternative to the sheer lugs 80 of FIG. 12 is shown, being dual sheer lugs 90. The dual sheer lugs 90 provide greater sheer resistance when compared to the single sheer lugs 80.

Figure 15:
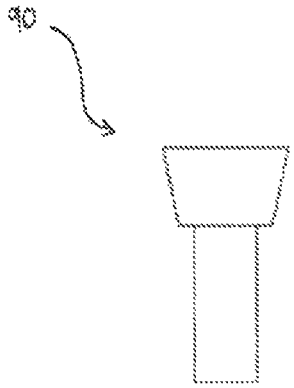
FIG. 15 is an end view of the dual sheer lug of FIG. 14.

FIG. 15 is an end view of the dual sheer lug of FIG. 14; and

In the embodiments of FIGS. 10-14, the building floor structure 10 is strengthened by the greater level of interlock between the I-beams 15 and the volume of concrete 38 and it is less likely that cracks in the volume of concrete will form.

Alternatively, the top flange may include spaced deformations. The deformations are best made in the plane of the flange to reduce the depth (cover) of concrete over the top of the flange. The deformations are typically notches cut from and/or blocks welded to the edge of the flange.

It is advantageous to utilize composite action in steel beam/concrete slab floor construction as about 25% greater spans can be achieved for the same steel section in configurations.

Figure 16:
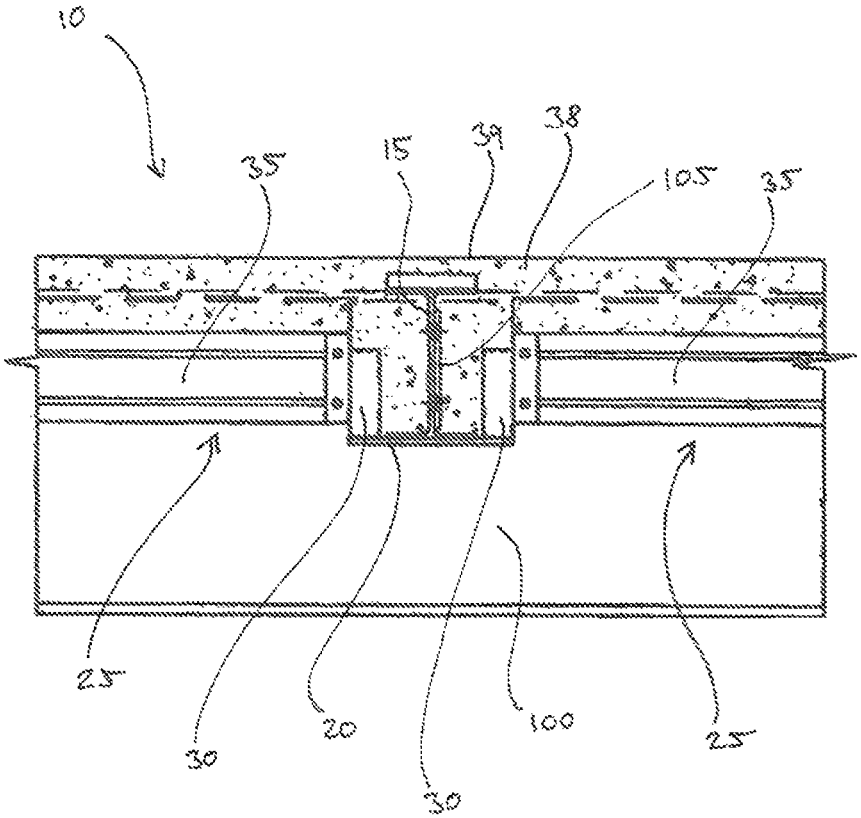
FIG. 16 is a section view of a building floor structure in accordance with another preferred embodiment of the present invention shown connected to primary I-beams.

FIG. 16 is a section view of a building floor structure in accordance with another preferred embodiment shown connected to primary I-beams 100. The I-beams 15 connect to the major structural elements of the building—a wall or in this case to the primary I-beams 100. In this case, the connection type is a cleat 105 welded to the vertical web of the primary I-beam 100, to which a respective I-beams 15 is bolted through its web. They are arranged so that the top surfaces of the beams 15, 100 are in the same plane.

Figure 17:
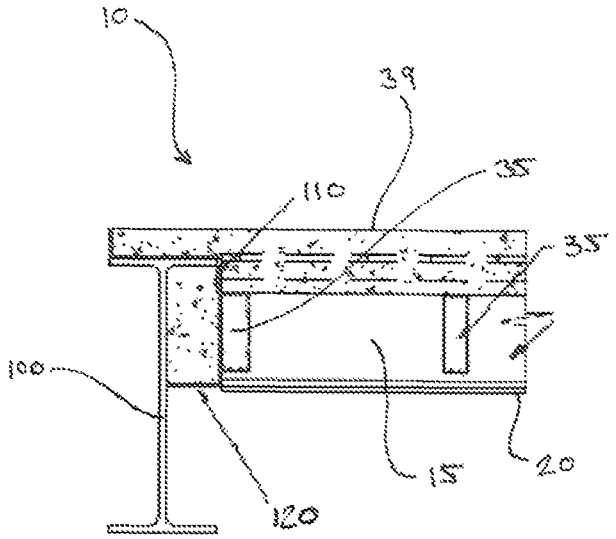
FIG. 17 is a section view of the building floor structure of FIG. 16 shown connected to the primary I-beams.

FIG. 17 is a side view of the building floor structure 10 of FIG. 16. The building floor structure 10 further comprises a blocking angle 110, fixed to the end joists 115 and connecting to respective primary I-beams 100, and a U-shape blocking section 120 fitted between the end joists 115 and the primary I-beams 100 under the top flange of the primary I-beams 100.

In other embodiments of the invention:

1. Each framework further comprises recessed portions defining the bearing surfaces.
2. Each of the beams further comprises an elongate, laterally extending beam flange aligned with the beam on both sides of the beam, the support surfaces being provided by the upper surfaces of the beam flanges.
3. The bottom flange of each I-beam is wider than the top flange and the support surfaces are provided by an upper surface of the bottom flange on each side of the vertically oriented web. This allows the frameworks to be more easily positioned on the I-beams. The pre-assembled frameworks are lowered into position where the bearers sit with adequate bearing on the outside edge of the bottom flange of the I-beams. This is advantageous since, in terms of fire design, it is important to have concrete encasing as much of the beam as possible. This floor structure design keeps the bulk of the bottom flange in direct contact with concrete for better heat dissipation.
4. The reinforcement rods can be replaced by a reinforcement grid, mesh or any other suitable engineering reinforcement arrangement or material.
5. The I-beams and/or plates and/or bearers and/or joists are steel sections.
6. The bearer may be a C-section open towards the I-beam's web or a boxed section with holes facing towards the beam's web to allow the remaining edges of the bottom flange of the I-beam to be protected by concrete.
7. The decking panels are panels of wave, rectangular or trapezoidal corrugated steel, aluminum or plastic sheet, or longitudinally-joined steel or aluminum roofing strip material or timber boards or sheeting such as plywood.
8. The bearers are cold rolled-hollow-sections.
9. The joists are cold rolled-hollow-sections.
10. The bearers, beams, plates and joists are made from wood, steel, aluminum, plastic, composite (e.g. concrete composite) or any other suitable engineering material.
11. The beams may actually be a top portion of a wall of a building.
12. The decking panels may be fixed to the joists by rivets, nails or an adhesive.

In another embodiment of the invention, a process for constructing a building floor structure 10 is provided, comprising the numbered steps below.

1. Providing a plurality of prefabricated frameworks 25 assembled with decking panels 37.
2. Locating each of the frameworks 25, between two adjacent I-beams 15, such that the bearing surfaces 50 rest on respective support surfaces 60, 65.
3. Pouring concrete into and above a volume defined by the beams 15 and the one or more frameworks 25 such that the volume of concrete 38 covers the top surfaces of the beams 15; and
4. Screeding the concrete flat.

Advantageously, this process for constructing a building floor structure 10 uses less concrete than laying decking panels on the bottom flange of an I-beam 15.

Advantageously, the overall depth of the floor structure 10 from the top surface of the concrete to the underside of the I-beams 15 is less than using composite metal decking fixed to the top flanges of the I-beams 15.

Advantageously, the frameworks 25 can be prefabricated and located in position on-site. This reduces on-site labor requirements and increases the speed of construction on-site.

Advantageously, the frameworks 25, when adapted to support the weight of concrete and loading before the concrete has set, do not require a temporary support structure underneath. Consequently, the risk of injury or death can be reduced.

Preferably, the framework 25 and decking panels 37 are pre-assembled before being transported to site ready for placement by installation team. Placement of the prefabricated framework 25 can be done manually when its size is manageable and weight is considered acceptable for lifting and handling. However, the fastest and most cost efficient method will be to install large deck assemblies of multiple frameworks 25 using a crane and that also satisfies a primary objective which is to reduce the number of installers on site to, in turn, reduce safety management risks.

A pre-assembled framework 25 including decking panels 37 that is placed by crane takes a significant amount of labor off the construction site. There is no welding or mechanical connecting of individual lost formwork sheets, so the number of people involved in the installation of the floors is significantly reduced, with consequential improvements to both site safety and speed of construction. The frameworks 25 naturally align to the supports, are robust of their own accord, and require just a simple clip to temporarily secure them.

In addition to the benefits of placing large frameworks 25 by crane, further speed of construction improvements will be achieved through improved materials management and handling techniques. Multiple sections of frameworks 25 will be craned to the construction floor area with the capacity to release the first, move to the next location, release the second, and so on. The objective is to maximize the square meter of floor area installed per crane lift. A further advantage of this is in the management of material delivery to the site. A "pack" of floor frameworks 25 is removed from the delivery truck in a single lift within minutes of its arrival and is installed immediately.

One week per floor structure completion times are considered fast for concrete frame structures and this requires the use of post tensioning with high early strength concrete. Steel frame structures can be faster, but tend to be constrained by the speed of floor construction as the composite metal deck frameworks 25 are built in-situ. The present invention takes floor construction off the critical path and speeds of up to 2 days per floor may be realizable.

A pre-assembled framework which is lost formwork can be used as a ceiling support system, either by hangers or by fixing ceiling linings direct to the underside of the joists 35. When suspended ceilings are installed, the suspension rods can be fixed to the joists 35 using self-drilling screws. This is much safer, faster and quieter than drilling into concrete to then install an anchor.

An alternative to the lost frame formwork is a curved decking having sufficient structural integrity spanning between the beams 15.

A further embodiment of the invention includes pre-stressing the beams 15 so as to create a pre-camber and avoid the use of props altogether. This is achieved using cable that runs under spigots connected to preferably each side of the web of the beam 15. In the mid-span the spigots are close to the bottom flange with cable running under, and near the supports the spigots are near the top flange with cable running over, so as tension is applied to the cables, the center of the beam 15 is lifted upwards. This pre-tensioning can also be created by installing a temporary 'Barrup Truss' under the beam—a compression strut mid-span with tension cable anchored near the supports—again avoiding the use of a prop.

The filling of the space between the flanges of the I-beam 15 with concrete further allows for a post-tensioned composite steel beam, which is not known. A tension cable and conduit system can be pre-assembled in the intermediate beams, preferably one either side of the web, and provision made in the top flange to pass the cable through to apply tension and block off after concrete cure.

The floor structure 10 further offers alternative ways of managing noise resistance. Because the decking panels 37 do not need to work compositely with the volume of concrete 38, it's possible to place impact resistant and dampening material between the decking panels 37 and the volume of concrete 38. Additionally, the voids between the framework members can be filled or partially filled with noise insulating material.

INTERPRETATION

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention.

INDUSTRIAL APPLICABILITY

It is apparent from the above, that the arrangements described are applicable to the construction industry.

The invention claimed is:

1. A building floor structure comprising:

a plurality of spaced-apart I-beams, each I-beam supporting a poured concrete surface and having an I-shape cross sectional shape, and each I-beam comprising:

a vertically oriented web having a base; and one or more horizontally oriented base flanges connected to and extending across the base of the vertically oriented web and defining an upwardly facing support surface on an upper side of the one or more horizontally oriented base flanges; and a further horizontally oriented top flange connected to a top of the vertically oriented web and defining a downwardly facing surface on an underside of the top flange;

at least one framework positioned between and adjacent two of the plurality of spaced-apart I-beams, each of at least one framework having two side regions, each side region comprising a downwardly facing bearing surface adapted to be received on the upwardly facing support surface of each respective I-beam, each of the at least one framework further comprising:

a plurality of spaced-apart bearers aligned with the I-beams;

a plurality of spaced-apart joists attached to and extending transversely to the bearers;

at least one horizontally disposed decking member positioned on top of the plurality of spaced-apart joists; and a volume of concrete of a thickness less than a thickness between the upwardly facing support surface and the downwardly facing surface of two adjacent beams of the plurality of I-beams, the volume of concrete partially encasing a top of the I-beams and substantially filling a volume defined at least by the vertically oriented webs of the beams and the at least one decking member, wherein the volume of concrete covers top surfaces of the I-beams to thereby provide a continuous top surface to the floor structure.

2. A building floor structure as claimed in claim 1, wherein:

each framework has a framework bottom surface; and the bearing surface of the side regions defining a plane different from a plane defined by the framework bottom surface.

3. A building floor structure as claimed in claim 2, wherein:

the beams have beam bottom surfaces; and each framework bottom surface is located at or below a height of the beam bottom surfaces.

4. A building floor structure as claimed in claim 2, further comprising a plurality of elongate plates corresponding to the plurality of beams, each plate being aligned with and welded to the beam bottom surface and having at least one side extending horizontally beyond a width of the beam to provide the support surface.

5. A building floor structure as claimed in claim 4, wherein:

each of the beams has a bottom flange; and each bearer is attached to a respective bottom flange.

6. A building floor structure as claimed in claim 1, wherein each framework further comprises recessed portions defining the bearing surfaces.

7. A building floor structure as claimed in claim 6, wherein:

the bearers have bottom surfaces; and the bearing surfaces of each framework are provided by the bottom surfaces of respective ones of the bearers.

8. A building floor structure as claimed in claim 1, further comprising at least one plate attached to each of the bearers.

9. A building floor structure as claimed in claim 1, wherein each beam comprises a plurality of recesses shaped to mechanically key a volume of concrete surrounding the plurality of recesses.

10. A building floor structure as claimed in claim 1, wherein each beam comprises a plurality of lugs shaped to mechanically key a volume of concrete surrounding the plurality of lugs.

11. A building floor structure as claimed in claim 1, wherein each framework has a framework bottom surface, and further comprising at least one ceiling member attached to the framework bottom surface.

* * * * *